US006237838B1

(12) United States Patent
Bradenbaugh

(10) Patent No.: US 6,237,838 B1
(45) Date of Patent: May 29, 2001

(54) CONTAINER FOR A HOT WATER HEATER OR SIMILAR ARTICLE

(76) Inventor: Kenneth A. Bradenbaugh, 935 Woods Loop Dr., Weddington, NC (US) 28173

( * ) Notice: Subject to any disclaimer, the term of this patent is extended or adjusted under 35 U.S.C. 154(b) by 0 days.

(21) Appl. No.: 09/449,967

(22) Filed: Nov. 26, 1999

(51) Int. Cl.[7] ..... B65D 81/02; B65D 85/30

(52) U.S. Cl. ..... 229/109; 206/320; 206/486; 206/588; 229/122.27

(58) Field of Search ..... 229/109, 110, 229/122.27, 122.32, 122.33, 122.34; 206/320, 486, 588

(56) References Cited

U.S. PATENT DOCUMENTS

| | | | | |
|---|---|---|---|---|
| 2,321,063 | | 6/1943 | Bohnke . | |
| 2,453,829 | | 11/1948 | Blackman . | |
| 2,783,930 | | 4/1957 | Riley . | |
| 2,804,253 | | 8/1957 | Brandt . | |
| 2,932,438 | | 4/1960 | Smith . | |
| 2,936,880 | | 5/1960 | Kohlhaas . | |
| 3,107,780 | | 10/1963 | Stuckert . | |
| 3,145,901 | * | 8/1964 | Gile | 206/320 |
| 4,019,672 | * | 4/1977 | Giannini | 206/320 |
| 4,823,956 | | 4/1989 | Belisle | 206/523 |
| 4,919,306 | * | 4/1990 | Heaps, Jr. et al. | 229/122.32 |
| 4,955,474 | | 9/1990 | Mattingly et al. | 206/320 |
| 5,069,338 | * | 12/1991 | Grigsby | 206/320 |

FOREIGN PATENT DOCUMENTS

| | | |
|---|---|---|
| 4019205 A1 | 12/1991 | (DE) . |
| 6-48478 | 2/1994 | (JP) . |

* cited by examiner

*Primary Examiner*—Gary E. Elkins

(57) ABSTRACT

A paperboard container for a hot water heater or similar manufactured article. The container comprising a body having eight sides, a bottom member closing the bottom of the container body, and a top member closing the top of the container body. The bottom member having eight bottom member sides, each bottom member side in contact with one of the eight body sides, having an interior face for supporting and preventing lateral movement of the hot water heater within the container, and having an exterior face for supporting the container on a floor or other surface. A tab on each container body side is attached to the bottom member exterior face for holding the bottom member in place as the container bottom. The container employs only about 85% of the paperboard required in a square cross section container for the same size hot water heater, and has greater strength than the square cross section container.

10 Claims, 3 Drawing Sheets

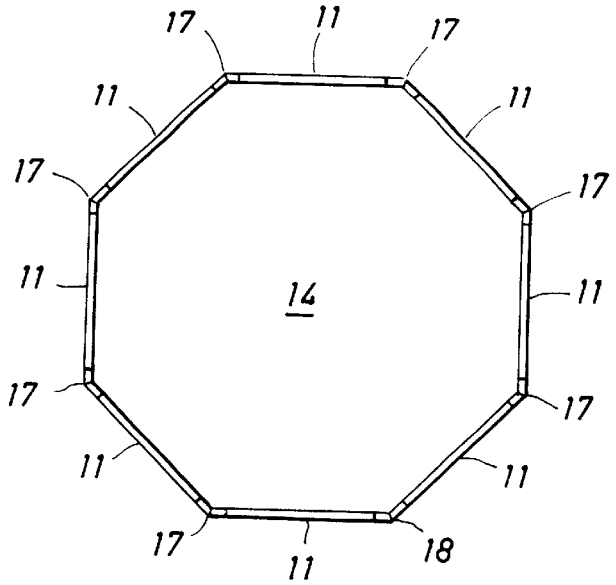
FIG. 2
FIG. 1
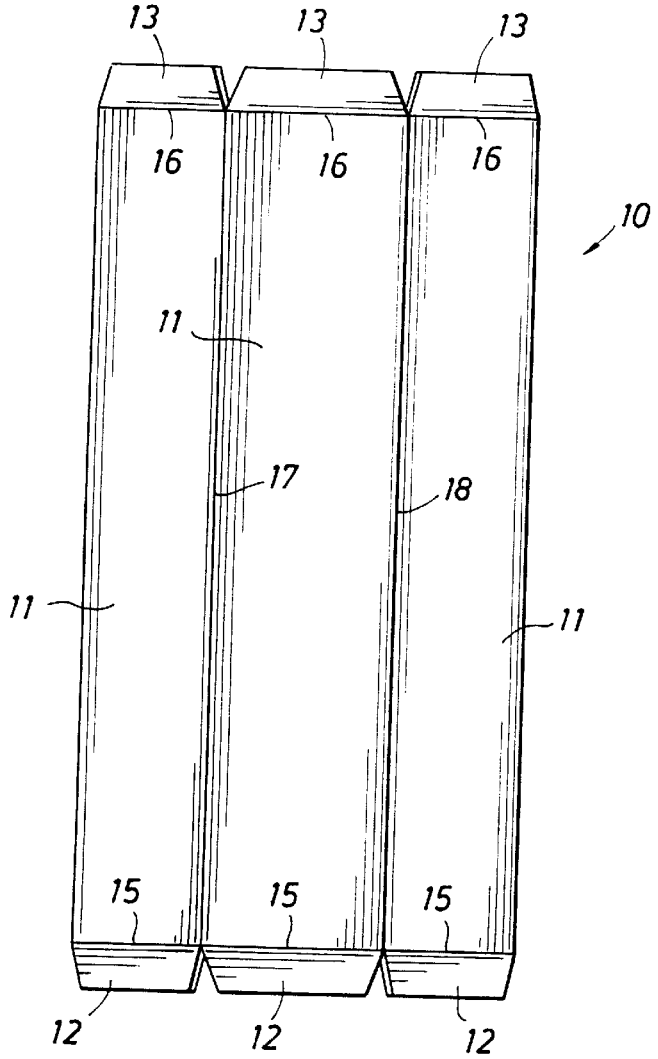

FIG. 5
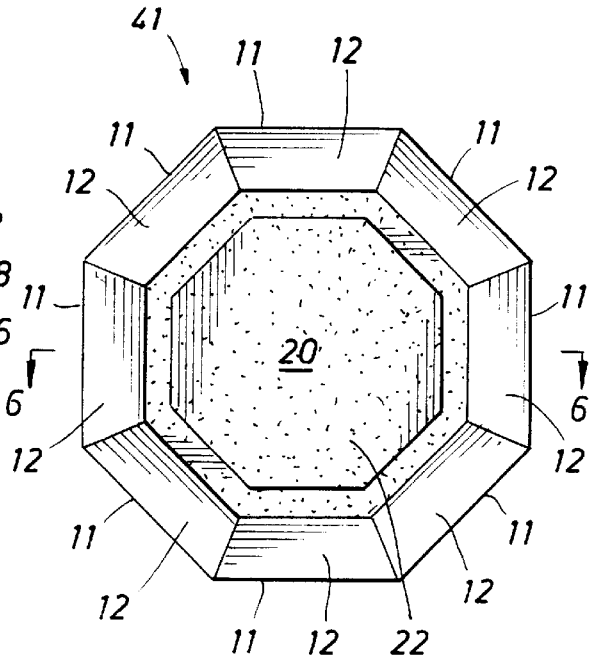
FIG. 6
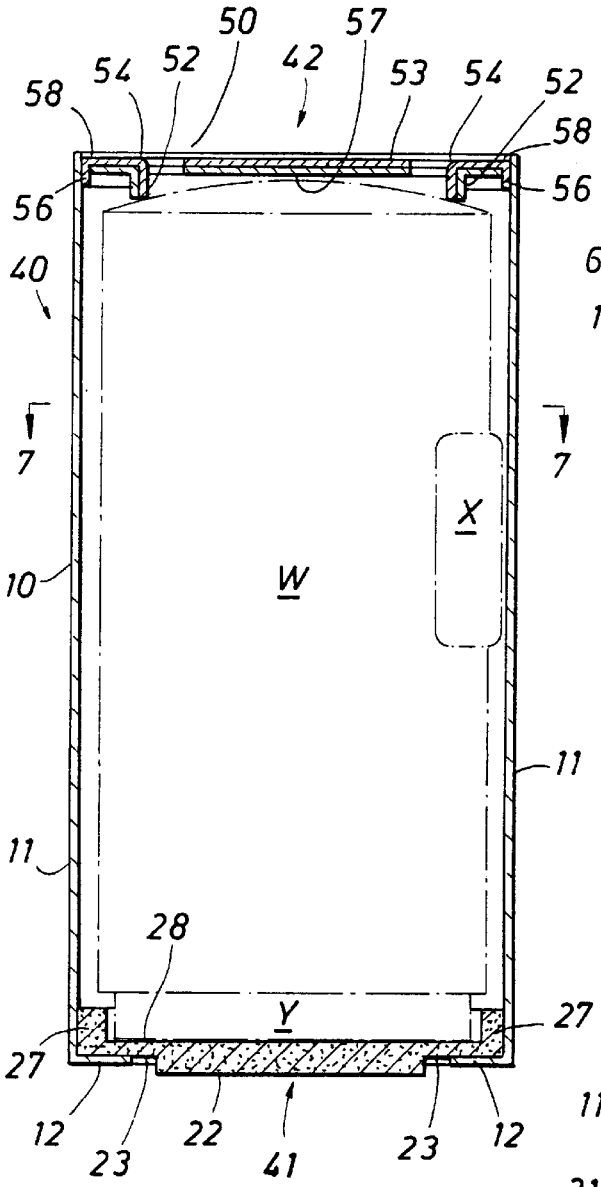
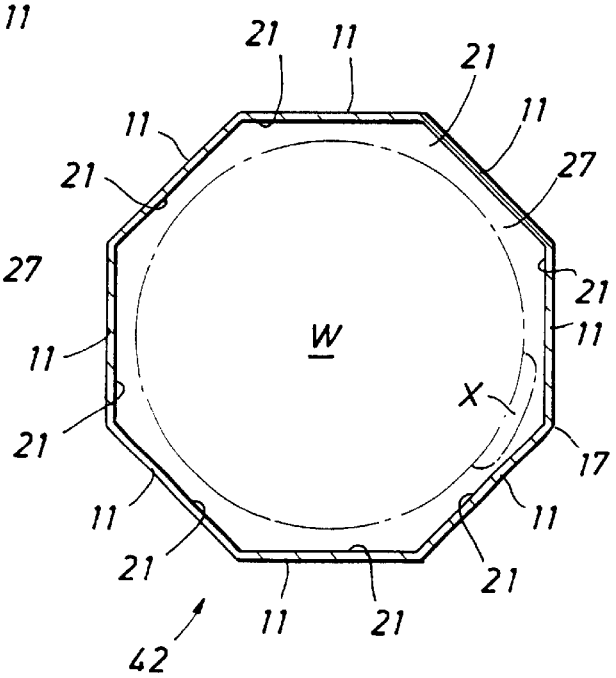
FIG. 7

CONTAINER FOR A HOT WATER HEATER OR SIMILAR ARTICLE

BACKGROUND OF THE INVENTION

The present invention relates to containers for protecting articles, such as domestic hot water heaters, during storage and shipment. More particularly, the present invention relates to containers which are economical in construction and which can bear the wear and tear of storage and shipment.

DESCRIPTION OF THE PERTINENT ART

Containers for manufactured articles, such as hot water heaters and other appliances, commonly comprise boxes made of corrugated paperboard. Each such container has a height and a generally square or rectangular cross section sized to accommodate the manufactured article. The container may include a bottom support structure made of stronger material, such as a wooden pallet, when the article to be contained is particularly heavy.

A hot water heater comprises a cylindrical shell, a foot portion at the lower end of the shell, and heater controls, (either gas or electric), protruding outward from the cylindrical shell. A Gas heated hot water heater also comprises a gas flue which extends upward from the top of the shell. The heater controls, for both gas and electric hot water heaters, protrude from one side of the shell, such that the cross section of the hot water heater is generally circular, except in the area where the heater controls protrude.

A container for a hot water heater, typical of containers presently employed for shipping and storing hot water heaters, is a corrugated paperboard box having a top, a bottom and four side walls, and having a square or rectangular cross section with dimensions sufficient to accommodate the hot water heater circular shell and protruding heater controls. The container bottom comprises four bottom tabs, each bottom tab attached to one of the container sides, folded over and attached to each other with adhesive. The container top generally comprises four top tabs, each top tab connected to one of the container sides, folded over and attached to each other with adhesive. In some cases, a top for a container intended for a gas fired hot water heater may be a top member, having an opening through which the hot water heater gas flue extends. As the container cross section is either square or rectangular, and the hot water heater cross section is generally circular with a protrusion on one side as a result of the heater controls, substantial free space exists between the hot water heater shell and the container interior sides.

A hot water heater is generally loaded into such a container by sliding the container, with bottom and top tabs unattached, over the hot water heater and then attaching the bottom tabs and top tabs with adhesive to form the closed top and bottom of the container. The foot portion of the hot water heater rests on the interior of the container bottom.

The container, with a hot water heater inside, is commonly moved within manufacturing and storage facilities using a lift truck having clamp arms adapted for gripping two parallel flat sides of the container. The lift truck engages the container with the clamp arms, lifts the container off the floor and moves the container to a desired location where the lift truck sets the container onto the floor and disengages the clamp arms. The container bottom bears the weight of the hot water heater, and, if the bottom is damaged or becomes wet during storage or shipment, the container may fail and the hot water heater may fall through the bottom of the container.

Such a container is necessary for protecting a hot water heater, or similar article, during storage and shipment. The container represents a significant expense in the manufacture of a hot water heater, or other article. However, after a hot water heater, or other article, is delivered for installation, the container is removed and discarded. Thus, improvements in containers for hot water heaters and similar articles, which reduce the cost of the containers and reduce the risk of damage during storage and shipment, will reduce the cost of manufacturing hot water heaters and similar articles.

SUMMARY OF THE INVENTION

Now, according to the present invention, I have discovered an improved container particularly useful for packaging an article of manufacture, such as a hot water heater, which, in one embodiment, comprises:

a container body connected to a bottom member and connected to a top member; the container body comprising a plurality of conjoint body panels forming sides of the container and defining an interior space for containing the article;

the bottom member forming a container bottom for supporting the article within the container, the bottom member having an exterior face, an interior face and having a periphery comprising a plurality of bottom member sides equal in number to the plurality of body panels with each bottom member side in contact with a body panel; and a plurality of bottom tabs, each bottom tab of the plurality of bottom tabs in hinged connection with a body panel and attached to the bottom member exterior face;

the bottom member exterior face comprising a surface for supporting the container upon a floor surface and the bottom member interior surface for supporting the article within the container.

BRIEF DESCRIPTION OF THE DRAWINGS

FIG. 1 is a side view of a container body of the present invention, comprising a plurality of conjoint body panels.

FIG. 2 is an end view of the container body of FIG. 1.

FIG. 5 is a bottom view of an assembled container of the present invention, showing a container end member of FIG. 3 attached to bottom tabs of FIG. 1, forming a container bottom.

FIG. 6 is section C—C of the container of FIG. 5, showing a hot water heater, in dotted ghost outline, within the container.

FIG. 7 is section D—D of the container of FIG. 6, showing the hot water heater in dotted ghost outline.

DETAILED DESCRIPTION OF A PREFERRED EMBODIMENT

Figure 9:
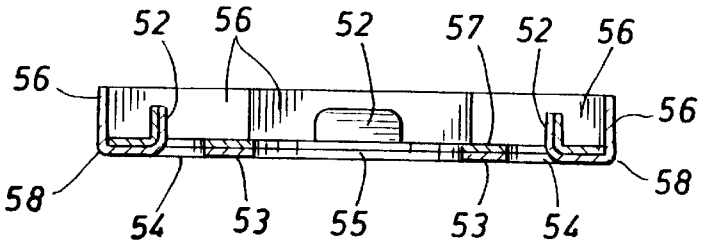
FIG. 9 is section B—B of the container end member of FIG. 8.

Containers of the present invention are intended for packaging manufactured articles, such as hot water heaters and similar appliances. The containers are sturdy, providing protection for the articles during shipping, storage and handling. Also, the containers are relatively inexpensive; thus suitable for one time use. After the articles, in containers of the present invention, are delivered for installation, the containers may be discarded without incurring a large expense. Preferably, the containers of the present invention are made of materials which may be recycled, particularly corrugated multiply paperboard.

A preferred embodiment of the container of the present invention, particularly useful as a container for a hot water heater, is described below. It is, however, to be understood that no limitation to the scope of the invention is intended and that such further applications and embodiments of the invention are contemplated as would occur to one skilled in the art to which the invention pertains.

The preferred embodiment of the present invention described below, which is a container for a hot water heater, is described with reference to the drawings of this Application. In the drawings, the same reference numeral for each element of the container will be used throughout, allowing easy reference from one drawing to another and avoiding confusion.

FIG. 1, is a side view of a container body comprising eight conjoined body panels and FIG. 2 is a top view of the container body of FIG. 1.

In FIG. 1 & FIG. 2, container body 10, comprises eight longitudinally aligned, conjoined body panels, (each body panel designated by a reference numeral 11), eight bottom tabs, (each bottom tab designated by reference numeral 12), and eight top tabs, (each top tab designated by a reference numeral 13). Container body 10 has an open bottom and open top, and defines an interior space 14 adapted for receiving a hot water heater. Hinged connections 17 connect adjacent pairs of body panels 11 along the body panels' lengths. Hinged connections 15 connect each body panel 11 to a bottom tab 12, and hinged connections 16 connect each body panel 11 to a top tab 13.

Container body 10 may be constructed of any suitable material, such as rigid foamed polymer, wood, wood composites, combinations thereof, etc. Preferably, Container 10 is made of a single sheet of multiply corrugated paperboard. Multiply corrugated paperboard is relatively inexpensive, light weight and readily commercially available in a variety of sizes, plies, thicknesses and strengths. Multiply corrugated paperboard may be readily shaped, as by die cutting, to desired dimensions. Further, as will be referred to below, multiply corrugated paper board may be crimped, as by use of pressure dies, for forming creases useful as hinged connections between sections of the paperboard sheet. As shown in FIG. 1 & FIG. 2, container body 10 comprises eight body panels 11 all having substantially the same length and width. Consequently container body 10 has an octagonal cross section. According to the present invention, a container body may comprise three or more body panels. each of which may have the same or different widths. Preferably, container body 10 will comprise a multiple of four, (e.g. 4, 8, 12, etc.), body panels 11 such that any two body panels 11 facing one another across interior space 14 of container body 10 are parallel. A container comprised of a container body having parallel sides may be gripped with the clamp arms of a lift truck for transportation from one place to another without damage to the container or its contents. For the preferred embodiment of the invention, shown in the drawings and described herein, container body 10 preferably comprises eight body panels 11 such that interior space 14 will accommodate a hot water heater, as shown in FIGS. 5, 6 & 7 and described below.

In FIG. 1 & FIG. 2, container body 10, including body panels 11, top tabs 13 and bottom tabs 12, is formed from a single sheet of multiply corrugated paperboard. Each body panel 11 is adjacent at least one other body panel on the sheet of multiply corrugated paperboard. The hinged connections 17 between adjacent body panels 11 each preferably comprise a crease in the paperboard. A connecting member 18 connects two body panels 11 from opposite sides of the paperboard sheet, for conjoining all the body panels 11 and defining the interior space 14 of container body 10. Connecting member 18 may comprise an adhesive tape, or other connecting means such as a tab, attached to the two opposed body members 11.

Each hinged connection 15 connecting a bottom tab 12 to a body panel 11 and each hinged connection 16 connecting a top tab 13 to a body panel 11 preferably comprises a crease in the sheet of paperboard allowing top tabs 13 and bottom tabs 12 to be folded inward toward, respectively, the open top and open bottom of container body 10. As described above, creases in the paperboard may be formed by well known methods, such as with pressure dies which compress the corrugated paperboard and form the creases without cutting or tearing. Each crease is placed on the appropriate side of the sheet of paperboard for forming a hinged connection 15, 16, or 17 which flexes in the appropriate direction.

Each top tab 13 and bottom tab 12 has a width, a length and a thickness. Preferably the width of each top tab 13 and bottom tab 12 is substantially the same as the width of the body panel to which it is connected at the respective hinged connection 16 and 15, and tapers along the tab length such that adjacent top tabs and adjacent bottom tabs will not overlap when folded inward. For the present embodiment of the invention, having eight body panels 11, the angle of taper of the width of each tab 15 and 16 is preferably about 27.5°.

Figure 4:
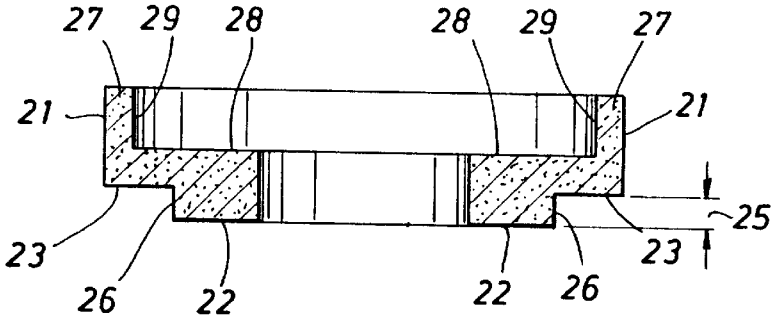
FIG. 4 is section A—A of the container end member of FIG. 3.
Figure 3:
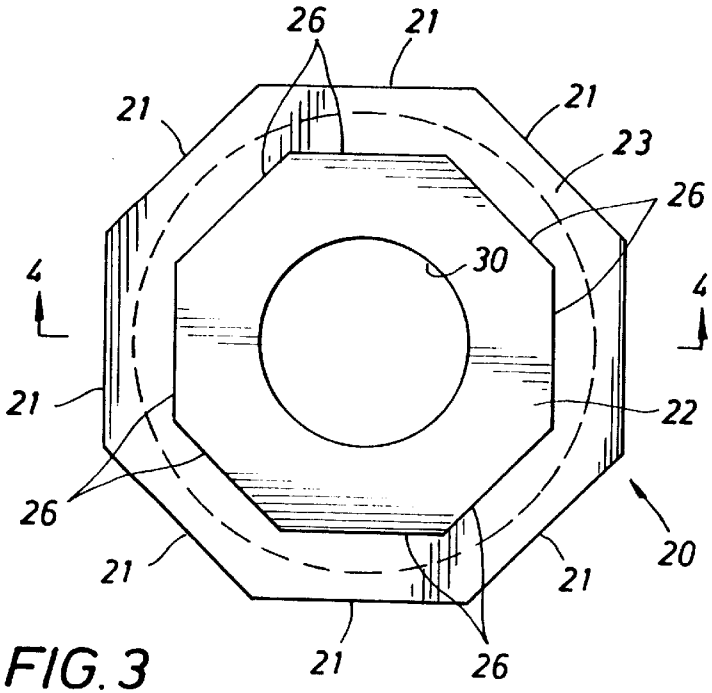
FIG. 3 is a bottom view of one embodiment of a container end member of the present invention.

FIG. 3 shows a container end member 20 of the present invention in bottom plan view. FIG. 4 is a sectional view of container end member 20, through section A—A of FIG. 3. Container end member 20 may be constructed of any suitable rigid material having sufficient strength to support the hot water heater, or other article, for which container, 10 is designed. Container end member 20 may comprise rigid foamed polymer, corrugated paperboard, wood, etc. Preferably, container end member 20 is constructed of rigid foamed polystyrene.

In FIG. 3 & FIG. 4, container end member 20 has a centrally disposed first exterior surface 22 and a second exterior surface 23 circumferentially disposed around first exterior surface 22. Second exterior surface 23 is recessed from first exterior surface by a distance 25 at least equivalent to the thickness of bottom tabs 12 of FIG. 1. Container end member 20 comprises eight peripheral sides 21, each peripheral side denoted by a reference numeral 21. Each peripheral side 21 has a length substantially equal to the width of a body panel 11 of FIG. 1. Where, as contemplated by the present invention, the number of body panels 11 is different from eight, and/or the width of all body panels 11 are not the same, the number and widths of the container end member sides 21 will match the number and widths of container body members 11.

In FIG. 3 & FIG. 4, container end member first exterior surface 22 has an outer periphery comprising eight first exterior surface sides, each first exterior surface side denoted by a reference numeral 26. As shown, each first exterior surface side 26 is substantially parallel to an end member side 21. Each parallel pair of end member sides 21 and first exterior surface sides 26 are separated by a distance at least equal to the length of a bottom tab 12, , such that each bottom tab 12 may lie flat against second exterior surface 23 when end member 20 is placed within the open bottom of container body 10.(Or, where end member 20 is to be used as a top end of a container, each pair of parallel end member sides 21 and first exterior surface sides 26 will be separated by a distance at least equal to the length of a top tab 13).

In FIG. 4, end member 20 comprises an interior surface 28 and a peripheral flange 27 rising from interior surface 28 about the periphery of end member 20. The eight end member sides 21 comprise the outside of peripheral flange 27. Preferably, interior surface 28 is of circular cross sectional area, however interior surface 28 may have a cross sectional area of another shape within contemplation of the present invention.

In an alternative embodiment, end member 20 defines a centrally disposed opening 30 communicating between first exterior surface 22 and interior surface 28. End member 20 of this embodiment is useful as a top end of a container for a gas fired hot water heater. The flue of the gas fired hot water heater may then extend through opening 30 without interfering with end member 20.

FIG. 5, FIG. 6, and FIG. 7 show a container, generally designated by numeral 40, comprising a container body 10 as shown in FIGS. 1 & 2, a container bottom 41 comprising a first container end member 20, (shown in FIGS. 3 & 4 and described above), and further comprising a container top 42 comprising a second container end member 50, (shown in FIGS. 8 & 9 and described below). It is to be understood that either first container end member 20 or second container end member 50 can be used as the top, bottom, or both top and bottom of a container 40 of this invention.

In FIG. 5 container 40 is shown in bottom view. FIG. 6, is section C—C of FIG. 5, showing container 40 in elevation. In FIG. 6, an electric hot water heater, designated by letter "W", having a heating control, (designated by letter "X"), and a base, (designated by letter "Y"), is shown in dotted ghost outline within container 40. FIG. 7 is sectional view of container 40, taken at elevation D—D of FIG. 6. In FIG. 7, cross sections of hot water heater "W" and heating control "X" are shown in dotted ghost outline.

In FIGS. 5 & 6, container bottom 41, comprises container end member 20 having a first exterior surface 22 and a second exterior surface 23. First container end member 20 is in the open bottom of container body 10 with each of eight container end member sides 21, (shown in FIGS. 3, 4, & 7), in contact with one of eight container body panels 11. The eight bottom tabs 12 of container body 10 are attached to second exterior surface 23 by suitable attachment means, preferably an adhesive and more preferably contact cement. As described in the description of FIGS. 3 & 4, above, second exterior surface 23 is recessed from first exterior surface 22 a distance at least equal to the thickness of bottom tabs 12 such that first exterior surface 22 protects bottom tabs 12 from damage during handling and shipping of container 40. As shown in ghost outline, hot water heater "W" is within container 40, with hot water heater support "Y" resting on interior surface 28 of first container end member 20. Peripheral flange 27 of first container end member 20 extends upward from interior surface 28 for preventing lateral shifting of hot water heater "W" within container 40.

In FIG. 6, second container end member 50, comprising eight end member tabs 56 attached to an end member panel 53 is positioned at the top of container 40 such that end member panel 53 closes the open top of container body 10 and each end member tab 56 is attached to a body panel 11. End member tabs 56 may be attached to body panels 11 by any convenient means, such as staples or adhesive, preferably with contact cement.

FIG. 7 is a cross section of container 40 at the level D—D shown if FIG. 6. In FIG. 7, container end member sides 21 of first container end member 20 are in contact with container body panels 11. Hot water heater "W" is centered within container 40, and hot water heater controls "X" extend into a space created by the connection 17 of two container body panels 11. FIG. 7 demonstrates a particular advantage of this embodiment of the present invention. The octagonal cross section of container body 10 of container 40 has a circumference, (sum of the lengths of the eight sides 21), about 15% less than the circumference, (sum of the four sides), of a square container of a size sufficient to contain the hot water heater "W" with heater controls "X". Consequently, the amount of material required to construct the eight body panels 11 of container 40 is about 15% less than the amount of material required to construct a square container such as is presently used to package hot water heaters. Since the cost of materials of construction represent the major portion of the cost of containers such as those described here, a 15% reduction in the cost of materials results in a material reduction in the cost of containers. Should all hot water heaters produced in the United States be packaged in the containers of the present invention, (rather than the square containers presently used), the savings would amount to about $ 20 million per year.

Figure 8:
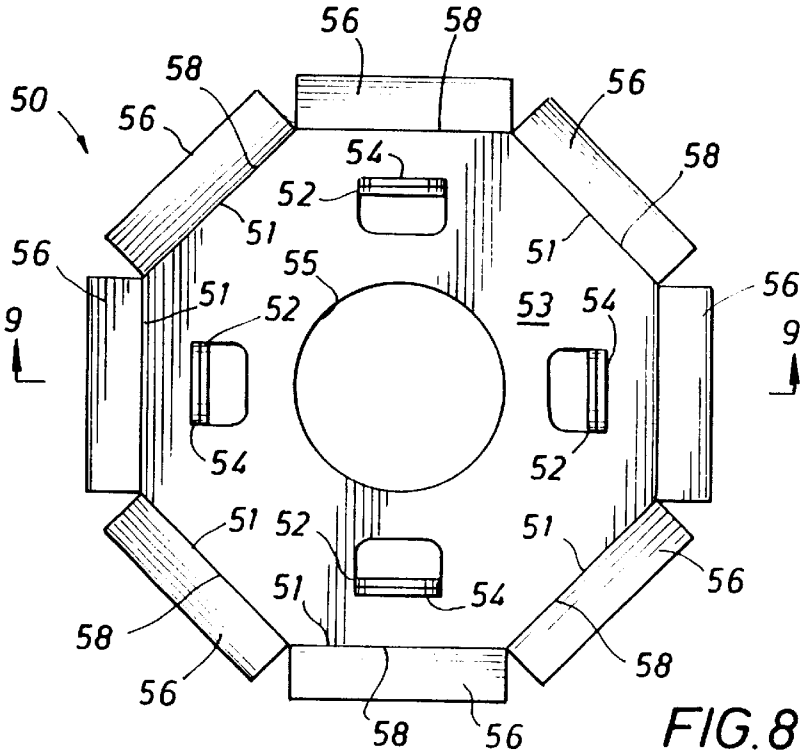
FIG. 8 is a top view of a second embodiment of a container end member of the present invention.

In FIGS. 8 & 9, a second embodiment of a container end member of the present invention is shown. FIG. 8 is a plan view of the interior face of container end member 50, and FIG. 9 is a sectional view of container end member 50 taken through section B—B of FIG. 8.

In FIG. 8, container end member 50 comprises an end panel 53 having a plurality of end panel sides 51. The number of end panel sides 51 are equal in number to the number of body panels 11 of a container body 10, (see FIG. 1 & 2), and each end panel edge is about equal in length to the width of a body panel 11, such that end panel 53 will fit within and close an open end of container body 10. End panel 53 is constructed of a rigid material having sufficient strength to withstand loads arising from end panel 53's use as the top or bottom of a container 40 shown in FIGS. 5 & 6. Non-limiting examples of such materials of construction include: rigid polymer foam; wood, plywood; wood composites; and preferably corrugated paperboard.

Container end member 50 further comprises a plurality of centering tabs 52 attached to and extending upward from end panel 53. Centering tabs 52 are disposed about end panel 53 in positions for preventing lateral movement of a hot water heater, or other article, to be contained in container 40 of which container end member 50 is a part. In the preferred embodiment, with end panel 53 comprised of corrugated paperboard, centering tabs 52 are preferably cut on three sides, as by die cutting, from the paperboard comprising end panel 53, and remain attached to end panel 53 by a fourth uncut side 54. In this preferred embodiment, centering tabs 52 are placed into their positions extending upward from end panel 53 by pushing upward on each centering tab 52, thus creasing the paperboard at the joinder of centering tab side 54 to end panel 53. In an alternative embodiment, end panel 53 defines a central opening 55 for allowing extension of an object, such as the flue of a gas fired hot water heater, from the interior of container 40 without interference with end panel 53. In another embodiment, a protective member 57, (FIG. 9), is attached to end panel 53 for protecting a hot water heater, or other article, contained in container 40 from shocks experienced when moving and handling container 40. Protective member 57 may comprise any convenient shock absorbing material, such as a sheet of foam rubber, fiber mat, resilient foamed polymer, plastic bubble pack, etc., and is attached to end panel 53 by any convenient means, such as an adhesive.

Container end member 50, when placed in the open top or open bottom of a container body 10, (FIGS. 1 & 2), may be connected to container body 10 by attaching tabs 13 or bottom tabs 12, as appropriate, to end panel 53 by any convenient attachment means, such as staples or adhesive, which have the necessary attachment strength. Preferably, however, end tabs 56 are connected to each side 51 of container end member 50. and each end tab 56 is attached to a body panel 11 of container body 10 for attaching container end convenient means, such as staples or adhesive, preferably contact adhesive.

In FIG. 8, a hinged connection 58 connects each end tab 56 to a container member side 51. Each hinged connection 58 may comprise reinforced tape, or any other convenient hinge. In the preferred embodiment, where container end panel 53 comprises a sheet of corrugated paperboard, each end tab 56 is integral with container end panel 53 and comprises part of the same sheet of paperboard as container end panel 53. In this preferred embodiment, each hinged connection 58 comprises a crease in the sheet of paperboard at each container end member side 51.

Thus, light weight, inexpensive containers for hot water heaters, or other articles, are disclosed herein. Although preferred embodiments of the present invention have been described here in detail, it will be understood by those skilled in the art that variations and modifications may be made to the preferred embodiments without departing from the spirit and scope of the invention. No limitation to the scope of the invention is intended other than limitations included in the appended claims.

I claim:

1. A container for an article, comprising:

a). a container body comprising a plurality of body panels conjoined for defining a container interior space for receiving an article, said container body having a first open end and a second open end, each body panel, of the plurality of body panels, having a body panel length, a body panel width, a body panel first end adjacent the container body first open end, a body panel second end adjacent the container body second open end, a body panel interior surface and a body panel exterior surface;

b). a container first end member, for closing the container body first open end, connected to the container body within the container body first open end, said container first end member having a first end member interior face, a first end member exterior face, a plurality of first end member sides equal in number to the plurality of body panels, and having first end member centering means connected to the first end member interior face for preventing an article from moving laterally within the container, each first end member side, of the plurality of first end member sides, in contact with the interior surface of a body panel of the plurality of body panels;

c). a plurality of first end tabs equal in number to the plurality of body panels, each first end tab, of the plurality of first end tabs, having a first end tab width, a first end tab length, a first end tab thickness, and a first end tab interior surface;

d). a plurality of first end hinged connectors, equal in number to the plurality of body panels, each first end hinged connector, of the plurality of first end hinged connectors, connecting a first end tab, of the plurality of first end tabs, to the first end of a body panel, of the plurality of body panels, the interior surface of each first end tab, of the plurality of first end tabs, attached to the first end member exterior face;

e). the container first end member exterior face comprising a circumferentially disposed first end member peripheral surface adjacent to the plurality of first end member sides, the first end member exterior peripheral surface having a first end member peripheral surface width at least equal to the length of each first end tab, of the plurality of first end tabs;

f). the container first end member exterior face further comprising a centrally disposed first end member exterior central surface, surrounded by the first end member exterior peripheral surface and extending from the first end member exterior peripheral surface a distance at least equivalent to the thickness of each first end tab of the plurality of first end tabs; and g). the interior surface of each first end tab, of the plurality of first end tabs, attached to the first end member exterior peripheral surface.

2. The container of claim 1, including:

the container first end member interior face comprising a first end member interior flange, having an upper flange surface, an inner flange periphery, an outer flange periphery comprising the plurality of first end member sides, and a first end member interior surface recessed below the upper flange surface, the first end member interior flange comprising the first end member centering means.

3. The container of claim 2, including:

a). the container body comprising a first paperboard sheet having a first sheet edge, a second sheet edge and a third sheet edge, which second and third sheet edges are parallel to one another, and the first paperboard sheet further having a plurality of body panel crimps, each body panel crimp parallel to the second and third sheet edges;

b). the plurality of body panel crimps defining the plurality of body panels;

c). each body panel crimp, of the plurality of body panel crimps, comprising a hinged connection along the length of adjacent body panels of the plurality of body panels;

d). each first end tab, of the plurality of first end tabs, comprising a portion of the first paperboard sheet adjacent the first paperboard sheet first sheet edge; and e). a plurality of first end tab crimps in the first paperboard sheet, each first end tab crimp, of the plurality of first end tab crimps, comprising a first end hinged connector, of the plurality of first end hinged connectors, between a first end tab, of the plurality of first end tabs, and a first end of of a body panel, of the plurality of body panels.

4. The container of claim 3, including:

the plurality of body panels numbering a multiple of four and comprising four or more pairs of body panels, each pair of body panels comprising two body panels in parallel alignment facing each other across the container interior space and forming two parallel sides of the container.

5. The container of claim 1, including:

a container second end member, for closing the container body second open end, connected to the container body within the container body second open end, said container second end member having a second end member interior face, a second end member exterior face, a plurality of second end member sides equal in number to the plurality of body panels.

6. The container of claim 5, including:

the container second end member defining an opening communicating between the second end member exterior face and the second end member interior face, for allowing a portion of an article to extend outwardly from the container.

7. The container of claim 5, including:

a second end member centering means connected to the second end member interior face for preventing an article from moving laterally within the container.

8. The container of claim 1, including:

a plurality of first end member tabs, each of which is connected to a first end body panel interior surface of a body panel of the plurality of body panels.

9. The container of claim 8, including:

a). the container first end member comprising a second paperboard sheet having a plurality of second paperboard sheet edges equal in number to the plurality of body panels;

b). each first end member tab, of the plurality of first end member tabs, comprising a portion of the second paperboard sheet adjacent a second paperboard sheet edge of the plurality of second paperboard sheet edges; and c). a plurality of first end member crimps in the second paperboard sheet, each of which comprises a hinged connector of a first end member tab, of the plurality of first end member tabs, to a first end member edge, of the plurality of first end member edges.

10. The container of claim 9, including:

the container first end member comprising a sheet of shock absorbing material attached to the second paperboard sheet.

* * * * *